US009027229B2

(12) United States Patent
Thorslund

(10) Patent No.: US 9,027,229 B2
(45) Date of Patent: May 12, 2015

(54) COIL ASSEMBLY COMPRISING PLANAR COIL

(75) Inventor: Robert Thorslund, Steningehöjden (SE)

(73) Assignee: ÅAC Microtec AB, Uppsala (SE)

( * ) Notice: Subject to any disclaimer, the term of this patent is extended or adjusted under 35 U.S.C. 154(b) by 0 days.

(21) Appl. No.: 13/978,191

(22) PCT Filed: Jan. 4, 2012

(86) PCT No.: PCT/EP2012/050075
§ 371 (c)(1),
(2), (4) Date: Jul. 3, 2013

(87) PCT Pub. No.: WO2012/093133
PCT Pub. Date: Jul. 12, 2012

(65) Prior Publication Data

US 2013/0278374 A1 Oct. 24, 2013

(30) Foreign Application Priority Data

Jan. 4, 2011 (SE) ..... 1150007

(51) Int. Cl.

| | |
|---|---|
| ***H01F 7/06*** | (2006.01) |
| ***H01F 27/28*** | (2006.01) |
| ***H01F 27/29*** | (2006.01) |
| ***H01F 41/04*** | (2006.01) |
| *H01F 17/00* | (2006.01) |

(52) U.S. Cl.
CPC ..... *H01F 27/2804* (2013.01); *H01F 27/29* (2013.01); *H01F 41/046* (2013.01); *H01F 2017/0066* (2013.01); *H01F 41/041* (2013.01)

(58) Field of Classification Search
USPC ..... 336/212, 232, 220, 221, 86, 178; 29/602.1, 607, 605, 606
See application file for complete search history.

(56) References Cited

U.S. PATENT DOCUMENTS

| | | | | |
|---|---|---|---|---|
| 6,060,976 | A | 5/2000 | Yamaguchi et al. | |
| 6,148,500 | A | 11/2000 | Krone et al. | |
| 6,831,543 | B2 * | 12/2004 | Mizoguchi et al. | 336/200 |
| 6,996,892 | B1 * | 2/2006 | Dening et al. | 29/602.1 |
| 7,250,842 | B1 | 7/2007 | Johnson et al. | |
| 7,480,980 | B2 | 1/2009 | Jung et al. | |
| 2006/0022787 | A1 | 2/2006 | Brennan et al. | |
| 2006/0267718 | A1 | 11/2006 | Salama et al. | |
| 2008/0238599 | A1 * | 10/2008 | Hebert et al. | 336/110 |
| 2011/0304422 | A1 * | 12/2011 | Taracila et al. | 336/200 |

FOREIGN PATENT DOCUMENTS

WO WO 2010/001339 A2 1/2010

* cited by examiner

*Primary Examiner* — Elvin G Enad
*Assistant Examiner* — Mangtin Lian
(74) *Attorney, Agent, or Firm* — Foley & Lardner LLP

(57) ABSTRACT

Coil assembly (1) comprising a planar coil (2) comprising a plurality of turns (15) arranged in a trench (10) in a first magnetic core plate (3) and a second magnetic core plate (8), where the first magnetic core plate (3) and second magnetic core plate (8) are in direct contact with each other or separated by an electrically insulating insulator layer (5) with a thickness (t) equal to or less than 50 μm and least one tap (6) extends from the coil (2) in a respective via hole (11) through the first magnetic core plate (3) to a respective contact pad (7), wherein the coil (2) and the tap (6) are integrally formed.

3 Claims, 16 Drawing Sheets

COIL ASSEMBLY COMPRISING PLANAR COIL

TECHNICAL FIELD OF INVENTION

The present invention relates to surface mountable coil assemblies, transformers with a planar coil or planar coils, and methods for making these.

BACKGROUND OF THE INVENTION

In many applications, for example power management, signal conditioning and signal isolation, high performance inductors formed by coils are needed. Planar coils comprise one or more turns of conductive material which generally all lie in the same plane (e.g. in the form of a flat helix) or in a small number of parallel planes (e.g. in the form of a plurality of helixes arranged in a stack of substantially parallel planes). The turns are connected by leads called "taps" to the outside. An assembly comprising the turns of the coil, the taps, the substrate on which the coil is fabricated, and the magnetic core is called a coil assembly. Planar coils have the advantage of relative low height compared to axial coils, thereby providing relatively a low package height and an overall smaller device.

There is a continuous desire to develop even more effective and compact inductors comprising coil assemblies for DC-DC converters, transformers, electrical motors for use in, for example, space, industrial, medical and consumer applications.

Preferably, coil assemblies comprising planar coils are surface mountable to a printed circuit board (PCB) in order to enhance the manufacturability of the incorporation of these coil assemblies into systems comprising further electronic devices on a PCB. For an electronic device to be surface mountable, it needs to be provided with contact pads on a surface of the device. These contact pads can then be provided with solder bumps which then are contacted to contact areas on the PCB, or said contact pads can be contacted to solder bumps present on contact areas on the PCB.

Traditionally, coil assemblies comprising at least one planar coil are fabricated by depositing (for example by electroplating) a coil conducting material (for example copper (Cu)) on a semiconducting or dielectric substrate. Thereafter, the turn pattern is patterned in a resist, and the coil conducting material is etched, thereby forming a planar coil. A magnetic core consisting of a first magnetic core plate, typically made of soft ferrite, is provided on one face of the substrate and a second magnetic core plate, typically also made of soft ferrite, is mounted on the opposite face of the substrate. The second core plate is placed in contact with the first magnetic core plate by means of protrusions from the second magnetic core plate which protrusions extend to the lower plate through holes provided in the substrate. By this arrangement of the coil assembly, the magnetic field is confined by the magnetic core plates above and below the coil and by any protrusions outside the perimeter of the outermost turn and any protrusions positioned inside the innermost turn.

To further increase the confinement of the magnetic flux and thereby increase the inductance it would be desirable to also have the magnetic core arranged in-between the individual turns of the coil. WO2010001339A2 teaches how to obtain a higher inductance through special back- and front-shielding. Here a coil is provided on a silicon substrate. A soft magnetic metal material is deposited on the top of the coil and it extends in-between the individual turns of the coil. A soft magnetic metal material is also deposited on the reverse side of the silicon substrate. Via holes are etched in the substrate, and these via holes are filled with soft magnetic material, thereby forming vias which couple the soft magnetic metal materials on the respective sides to each other, thereby increasing the magnetic confinement further. The vias are not electrically contacted to the coil.

In the above application the proportion of the height of the turns of the coil relative to the height of the total coil assembly is relatively low, since the height of the total coil assembly includes the thickness of the non-magnetic silicon substrate which does not contribute to magnetic confinement and inductance. The contacting of the coil is not described—it is merely mentioned that taps contact the turns of the coil.

U.S. Pat. No. 6,831,543 teaches a planar coil assembly mountable on the surface of a printed board, which assembly is said to have a small power loss and large inductance. This is achieved by providing a surface mountable coil assembly comprising a upper ferrite magnetic film, a lower ferrite magnetic film and a planar coil interposed therebetween, in which an opening is formed in the upper ferrite magnetic film above the planar coil terminal portion and an external electrode (corresponding to tap and contact pad in the present application) conductive with the coil terminal portion through the opening is formed on the upper ferrite magnetic film. It is further taught that the external electrode is preferably formed by treating conductor paste composed of mainly one of Ni, Pd, Pt, Ag, Au or alloy powder containing these materials or solder paste composed of mainly Sn by heat treatment. It is also taught that contamination halfway in the process could deteriorate the conduction from the coil terminal portion to the external electrode with accompanying voltage drop and, in the worst case scenario, failure of the device. This could be mitigated preferably by performing a light etching with acid or a clean with organic solvent before providing the external electrode. After forming the external electrode, a metal cap is formed which contacts the external electrode. The thickness of the lower ferrite magnetic film, which film is deposited, is limited to 100 μm. For the next thicker film thickness of 150 μm investigated the film peels and thus this greater thickness is shown to be unsuitable for use in a planar coil assembly. The thickness mentioned for the upper ferrite magnetic film is 40 μm.

U.S. Pat. No. 6,060,976 teaches a plane transformer which has a primary plane coil and secondary planes coils formed from a conducting film with an insulating resin film on its periphery. The primary plane coil and the secondary planes coils are fitted in a fitting groove formed on an upper surface of a first substrate (corresponding to first magnetic core plate in present application) composed of a magnetic substance. Obviously, the thickness of the substrate is not limited by film peeling or similar. The fitting groove has an entrance portion and an exit portion that both run out in a side surface of the first substrate. The coils are obtained by punching a stack of plural types of resin films with incorporated copper foil into a shape similar to that of the fitting groove, which copper foil has a thickness of approximately several tenths of μm. This is followed by coating the stack with resin film by dipping such that the side surface of the stack is coated by resin, and then the stack is dried. The coils are then inserted and fitted into the fitting groove. End portions of the secondary plane coils and the primary plane coil are positioned in an entrance portion and an exit portion of the fitting groove. The end portions of the coils have the resin removed, and thereby conductors are exposed, to which leads are connected. U.S. Pat. No. 6,060,976 do not teach how the leads are connected or if this could be made as a surface mountable device. On the upper surface of the first substrate a second substrate (corresponding to the second magnetic core plate in present application) of magnetic substance is mounted, which second substrate has a gap insulating layer of a thickness preferably between 1 and 50 μm provided on the surface facing the first substrate.

SUMMARY OF THE INVENTION

The main object of the invention is to provide surface mountable coil assemblies and transformers with a planar coil or planar coils comprising a plurality of turns arranged in a trench in a first magnetic core plate, thereby the first magnetic core plate extends in-between the individual turns of coil, and a second magnetic core plate, the first magnetic core plate and the second magnetic core plate being in direct contact with each other or separated by an electrically insulating insulator layer with a thickness equal to or less than 50 μm, where there is no interface between a coil terminal portion and a tap caused by different process steps. Any such interface could cause device degradation. The object is achieved by forming the coil and the taps in the same process step, so that they are integrally formed. In a preferred embodiment of the invention at least one contact pad is also formed in the same process step as a coil and a tap, so that the tap is integrally formed with the coil and the contact pad. In a preferable embodiment of the invention the first magnetic core plate has a thickness which is preferably in the range of more than 100 μm up to 4000 μm larger than the depth of the trench. Thereby, the inductance is further increased. In a preferable embodiment of the invention, the second magnetic core plate has a thickness in the range of 50 μm to 4000 μm.

In a preferable embodiment of the invention, the height of the turns of the coil is in the range of more than 100 μm up to 1100 μm, or preferably in the range of more than 150 μm up to 1100 μm or even more preferably in the range of more than 200 μm up to 1100 μm. This provides the further advantages of reduced coil resistance and power losses as well as enhanced cooling under high current densities.

Another object of the invention is to provide a method to manufacture a coil assembly according to the invention. The method comprises providing a first magnetic core plate with at least one trench, formed as a flat helix, and at least one via hole. Subsequently, the material which forms the coil is deposited in the trench or trenches and the material which forms the tap or taps is deposited in the via hole or via holes, so that the coil and the at least one tap are integrally formed thus removing any need for an intermediate light etching or cleaning step and a second process step to deposit the material forming the at least one tap. Preferably, the material which forms a contact pad connected to the at least one tap is deposited in the same step as the coil and the at least one tap, so that the at least one tap is also integrally formed with a respective contact pad. The method does not require any deposition of magnetic core material, and thereby cracking, peeling, delamination and the long deposition times for thicker magnetic films are avoided. This method further provides the possibility to increase the height of the turns of the coil and reduce the spacing between the turns. This is possible since depositing the coil conducting material in a trench means that the cross-sectional shape of the turns of the coils is not limited by the risk of collapsing structures which may occur during lithography, etching and cleaning of a freestanding structure used in traditional fabrication methods.

Embodiments of the invention are defined in the dependent claims. Other objects, advantages and novel features of the invention will become apparent from the following detailed description of the invention.

BRIEF DESCRIPTION OF THE DRAWINGS

Preferred embodiments of the invention will now be described with reference to the accompanying drawings, wherein.

Figure 1:
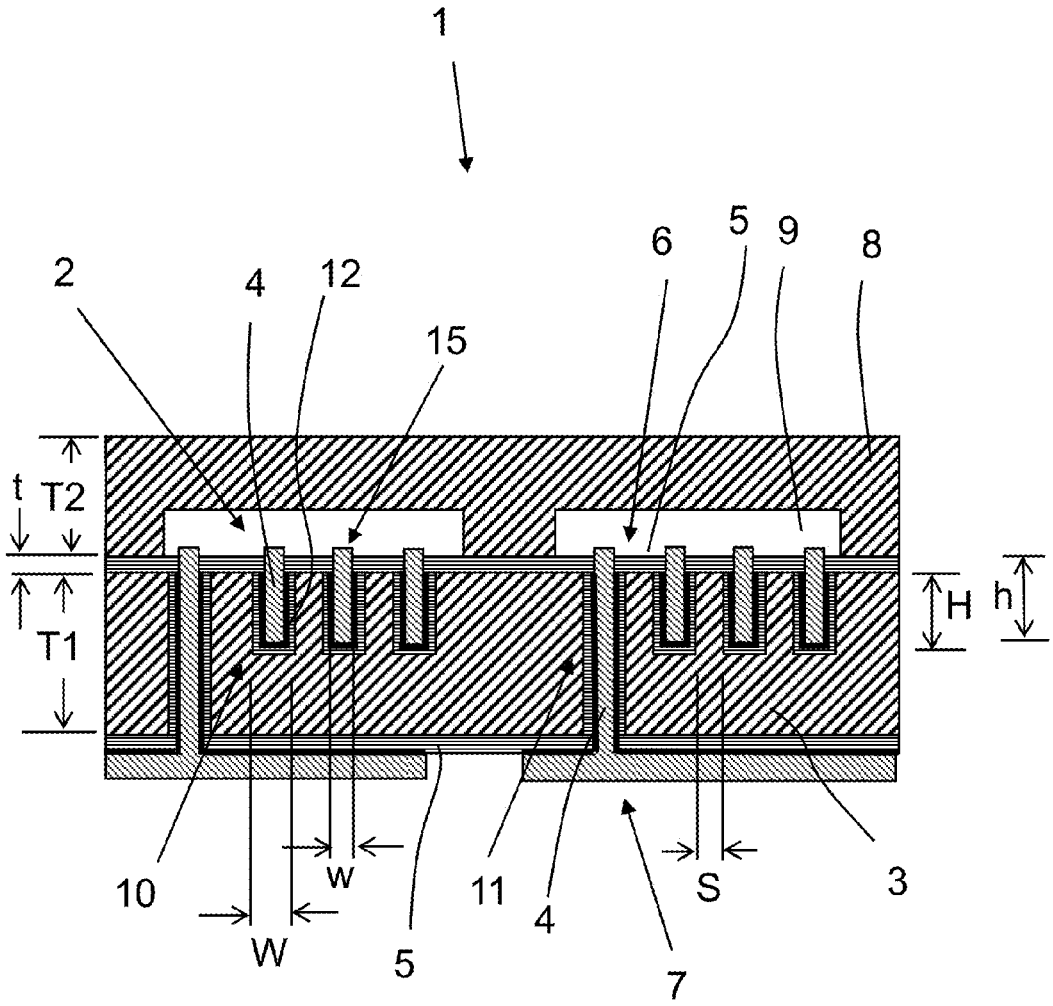
FIG. 1 shows a schematic lateral view of one embodiment of a coil assembly with a planar coil according to the present invention.

The proportions in the drawings are not according to scale. They are adapted to facilitate the legibility of the drawings.

DETAILED DESCRIPTION OF EMBODIMENTS

When the same reference number is included in several figures it denotes the same type of feature. FIG. 1 shows a lateral view of a coil assembly 1 according to the present invention comprising a planar coil 2, made of coil conducting material 4, preferably copper (Cu), for example Cu deposited on a seed layer 12 made of, for example, titanium (Ti) and copper (Cu), or titanium tungsten (TiW) and copper (Cu), comprising at least one turn 15 located in a trench 10 in a first magnetic core plate 3. The trench 10 is formed in the shape of the coil 2. The trench 10 preferably has a depth H in the range from 100 μm to 1000 μm. The width W of the turns 15 of the trench 10 is preferably in the range of 50 μm to 1000 μm, even more preferably in the range of 200 μm to 800 μm. Spacing S between two adjacent edges of two adjacent turns 15 of the trench 10 is preferably in the range of 50 μm to 1000 μm. The ratio of the width W of each turn 15 of the trench 10 to the depth H of the trench 10 is preferably 1:1.2 to 1:20 and more preferably 1:2 to 1:5. The ratio of the width w of each turn 15 of the coil 2 to the height h of the coil 2 is also preferably 1:1.2 to 1:20 and more preferably 1:2 to 1:5. The first magnetic core plate 3 has a thickness T1 which is preferably in the range of more than 100 μm up to 4000 μm larger than the depth H of the trench 10. The cross-sectional shapes of the turns 15 of the trench 10 are not limited to being rectangular, it may have any other shape such as V-formed, U-formed, semicircular or a shape with rounded corners. The cross-sectional shape of the turns 15 of the coil 2 is not limited to being rectangular, it may have any other shape such as V-formed, U-formed, semicircular or a shape with rounded corners and it may be different from the cross-sectional shape of the turns 15 of the trench 10. The trench 10 could be partly filled, exactly filled, or overfilled with coil conducting material 4. In the case of overfilling the trench 10 with coil conducting material 4 the turns 15 of the coil 2 could obtain a mushroom cross-sectional shape. The height h of coil conducting material 4 of the turns 15 of the coil 2 is preferably in the range of more than 100 μm up to 1100 μm, or more preferably in the range of more than 150 μm up to 1100 μm, or even more preferably in the range of more than 200 μm up to 1100 μm. The first magnetic core plate 3 comprises a magnetic material, for example soft ferrite. Between the coil 2 and the first magnetic core plate 3 a thin electrically insulating insulator layer 5, for example made of chemical vapour deposited poly(p-xylylene) polymers (e.g. Parylene™) with a thickness t preferably in the range of 1 μm to 50 μm, is provided to avoid current flowing from the coil 2 to the first magnetic core plate 3. In this embodiment of the invention the insulator layer 5 also covers the surface of the first magnetic core plate 3 in which the trench 10 is formed. However, it is possible to remove this insulator layer from regions where its insulating properties are not needed, for example the contact areas between the first magnetic core plate 3 and the second magnetic core plate 8 (described below).

Figure 2:
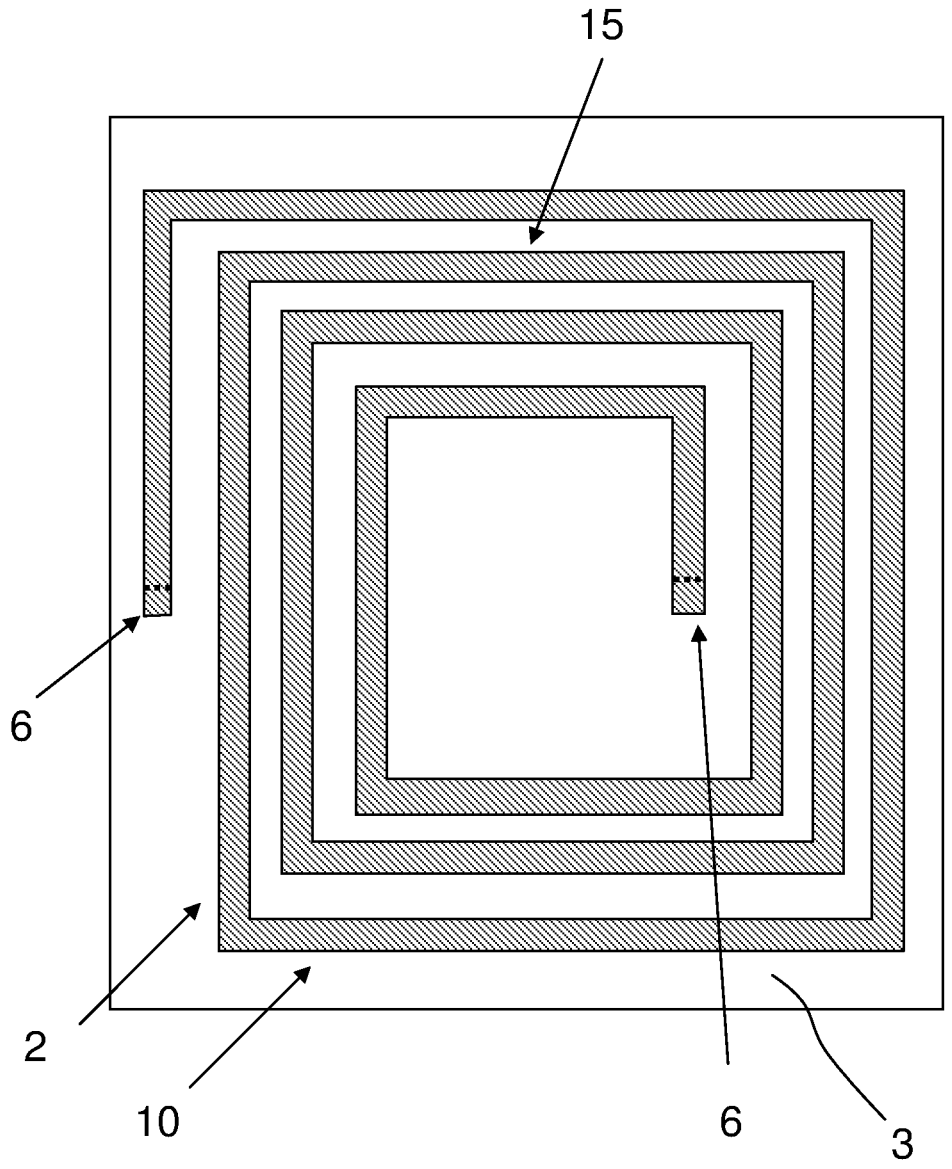
FIG. 2 shows a schematic plane view of one embodiment of a coil assembly with a planar coil according to the present invention with the second magnetic core plate removed.

To provide electrical contact to the coil 2, taps 6, integrally formed with the coil 2 and of the same material as the coil conducting material 4, extend from the coil 2 in their respective via hole 11 in the first magnetic core plate 3 to their respective contact pad 7. Preferably, each respective contact pad 7 is integrally formed with its respective tap 6 and thereby is made of the same material as the coil conducting material 4. In FIG. 1, the width or radius of the via hole is the same over the complete length of the via hole 11. However, other shapes may be preferred, which will be described later in this detailed description. Insulator layer 5 is also arranged to prevent current flowing from the taps 6 to the first magnetic core plate 3 and from the contact pads 7 to the first magnetic core plate 3. A second magnetic core plate 8 is arranged on the face of the first magnetic core plate 3 in which the trench 10 is formed, thereby enclosing the coil 2. In this embodiment of the present invention the insulator layer 5 remains on the first magnetic core plate 3 on the part of the surface of first magnetic core plate 3 which supports the second magnetic core plate 8. Alternatively, direct contact between the first magnetic core plate 3 and the second magnetic core plate 8 can be achieved by removal of the insulator layer 5 on the first magnetic core plate 3 on the part of the surface of first magnetic core plate 3 which supports the second magnetic core plate 8. The second magnetic core plate 8 comprises a magnetic material, for example soft ferrite. The second magnetic core plate 8 preferably has a thickness T2 in the range of 50 μm to 4000 μm. The second magnetic core plate 8 has a recess 9 dimensioned and arranged to prevent the coil 2 and the taps 6 coming into contact with it and to leave an air gap which gives the advantage of increasing the maximum saturation magnetic field. FIG. 2 shows a top view of the coil assembly 1 with the second magnetic core plate 8 removed. FIG. 2 shows a quadratic helical coil 2 with three and a half turns 15, but the coil 2 could also be formed with other shapes, such as a rounded helix. The locations of the taps 6 are shown. Here, three of the sidewalls of the taps 6 coincide with sides of the end portions of the coil 2. It is also possible to have wider taps 6 than end portions of the coil 2 by providing via holes 11 which are wider than trench 10. Preferably the edge of the via hole 11 does not extend over more than ⅔ of the spacing to an adjacent turn 15 of the trench 10. Even more preferably, the edge of the via hole 11 does not extend over more than half of the spacing to an adjacent turn 15 of the trench 10. It is also possible to provide the via holes 11 at some distance from the respective ends of the trench 10.

Figure 3:
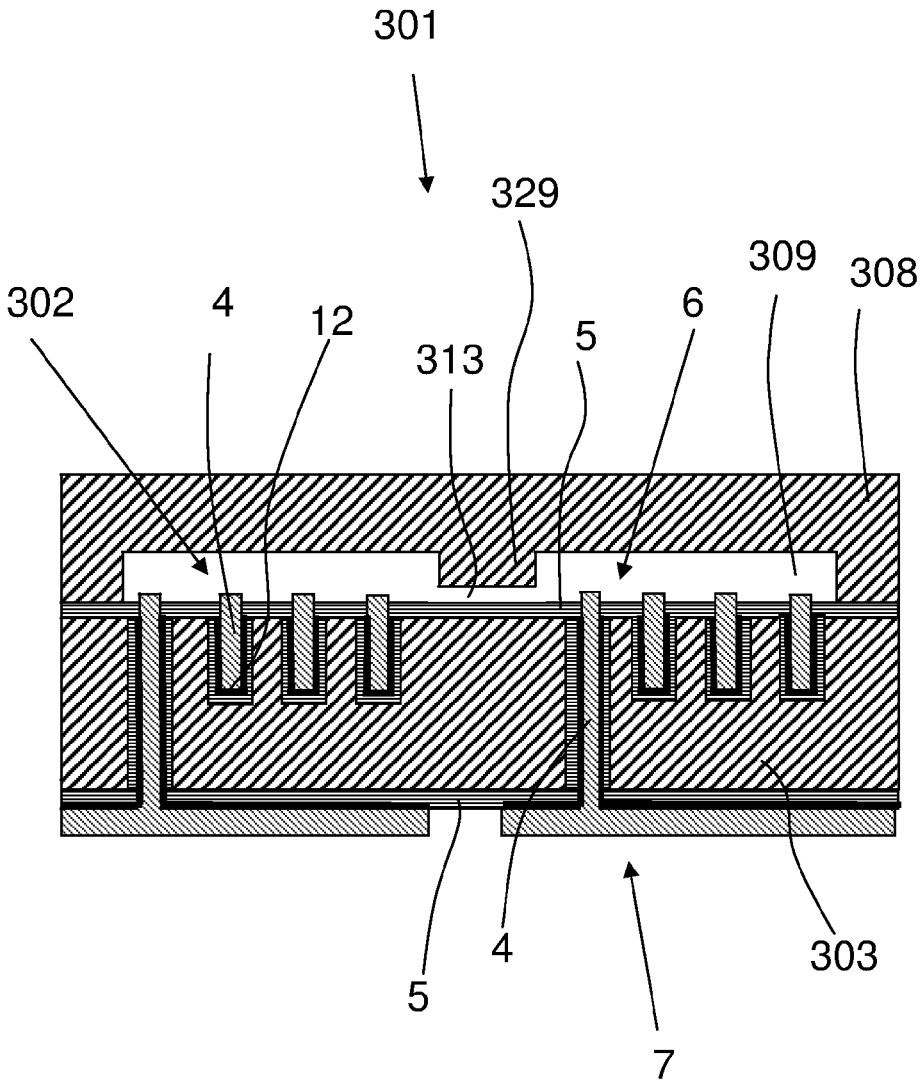
FIG. 3 shows a schematic lateral view of another embodiment of a coil assembly with a planar coil according to the present invention with an air gap in the centre of the coil between the first magnetic core plate and the second magnetic core plate.

FIG. 3 shows another embodiment of a coil assembly 301 with a planar coil 302 with an air gap 313 in the centre of the coil between the first magnetic core plate 303 and the second magnetic core plate 308. This gives the advantage of increasing the maximum saturation magnetic field. The centre air gap could also be the same as the air gap above the coil, resulting in a recess 309 with no protrusion 329 in the centre of the recess 309.

Figure 4:
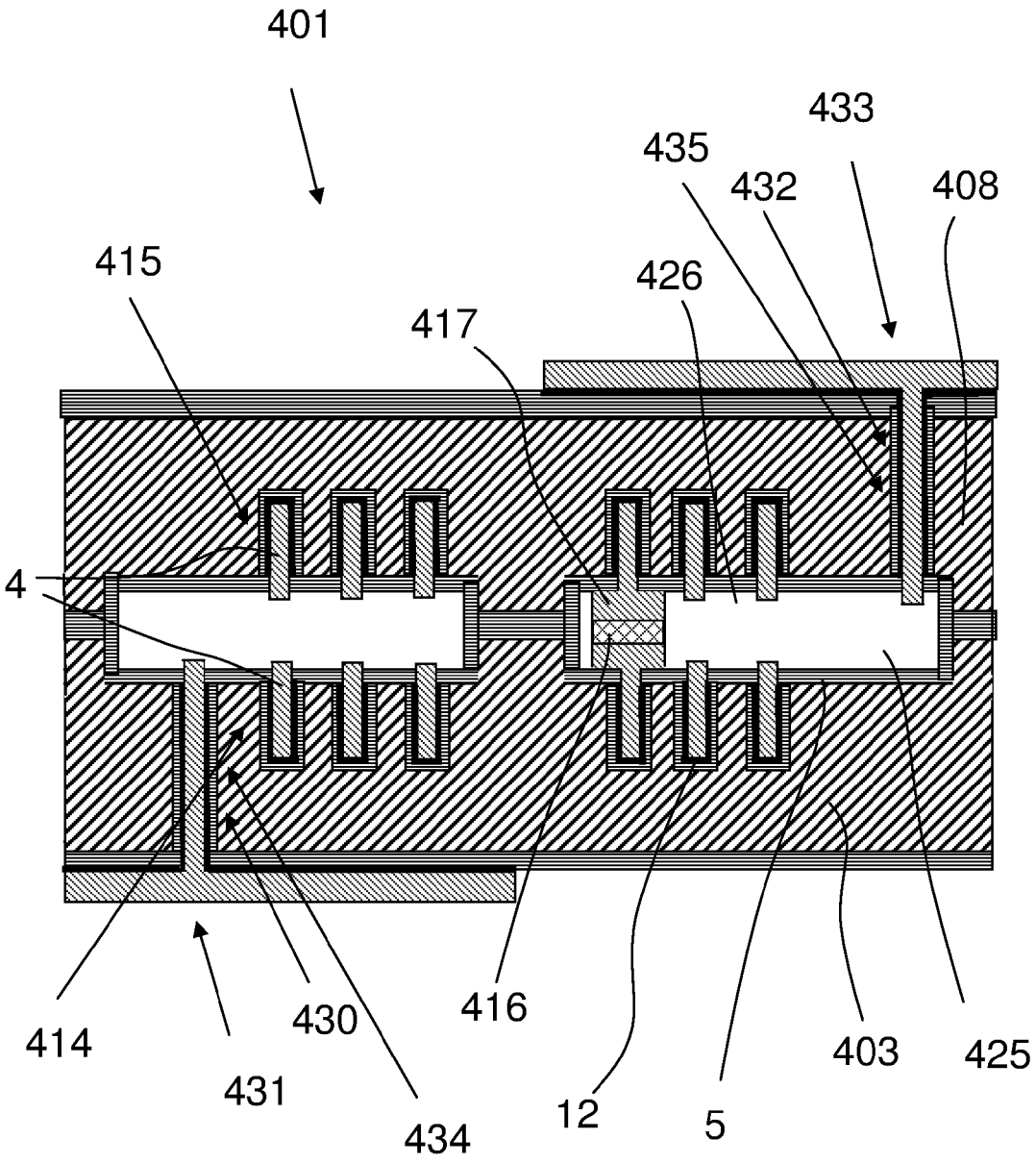
FIG. 4 shows a schematic lateral view of yet another embodiment of a coil assembly with a planar coil according to the present invention with a coil member in, and a tap through, the first magnetic core plate and a coil member in, and a tap through, the second magnetic core plate.

FIG. 4 shows yet another embodiment of a coil assembly 401 with a planar coil according to the invention with a first coil member 414 in the first magnetic core plate 403 and a second coil member 415 in the second magnetic core plate 408. In order to contact the first coil member 414 with the second coil member 415 a solder bump 416 (or other types of conductive arrangement, for example conductive glue), is arranged on the first magnetic core plate 403 in contact with the first coil member 414. Solder bump 416 is positioned such that it contacts a coil pad 417 on the second magnetic core plate 408, said coil pad 417 being in contact with the second coil member 415. A first tap 430 extends in a first via hole 434 in the first magnetic core plate 403 to a first contact pad 431 and a second tap 432 extends in a second via hole 435 in the second magnetic core plate 408 to a second contact pad 433. In this embodiment the first magnetic core has a recess 425 and the second magnetic core has a recess 426 which together leave an air gap between the coil members. Other configurations to form an air gap are also conceivable, for example by providing recesses only in one magnetic core plate.

Figure 5:
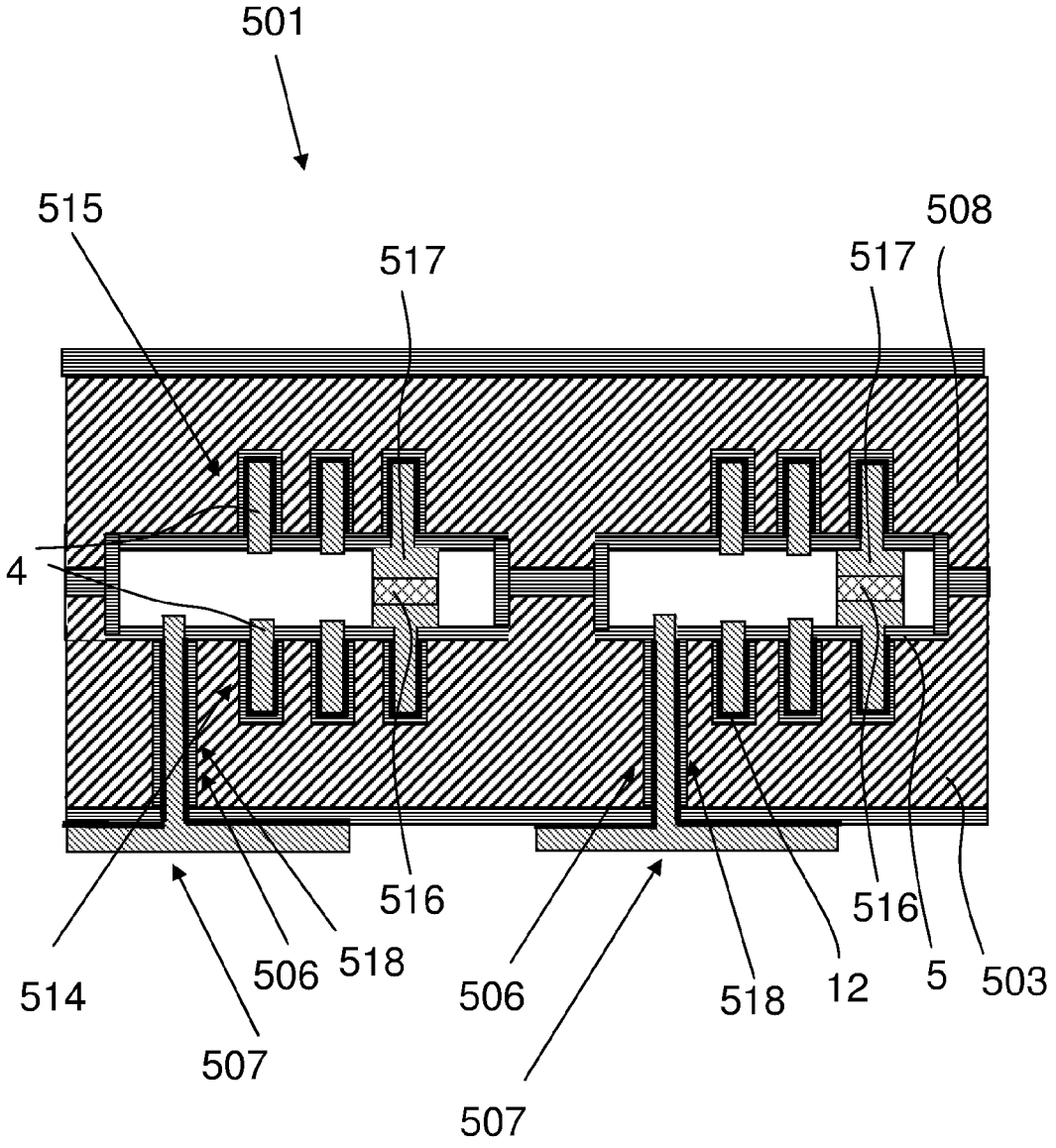
FIG. 5 shows a schematic lateral view of a further embodiment of a coil assembly with a planar coil according to the present invention with a coil member in, and taps through, the first magnetic core plate, and a coil member in the second magnetic core plate.

FIG. 5 shows a further embodiment of a coil assembly 501 with a planar coil according to the invention with a first coil member 514 in the first magnetic core plate 503 and a second coil member 515 in the second magnetic core plate 508. In order to contact the first coil member 514 with the second coil member 515 solder bumps 516 are arranged on the first magnetic core plate 503 in contact with the first coil member 514. They are positioned such that they each contact one of an equal number of coil pads 517 on the second magnetic core plate 508, said coil pads being in contact with the second coil member 515. Taps 506 extend in via holes 518 in the first magnetic core plate 503 to contact pads 507.

Figure 6:
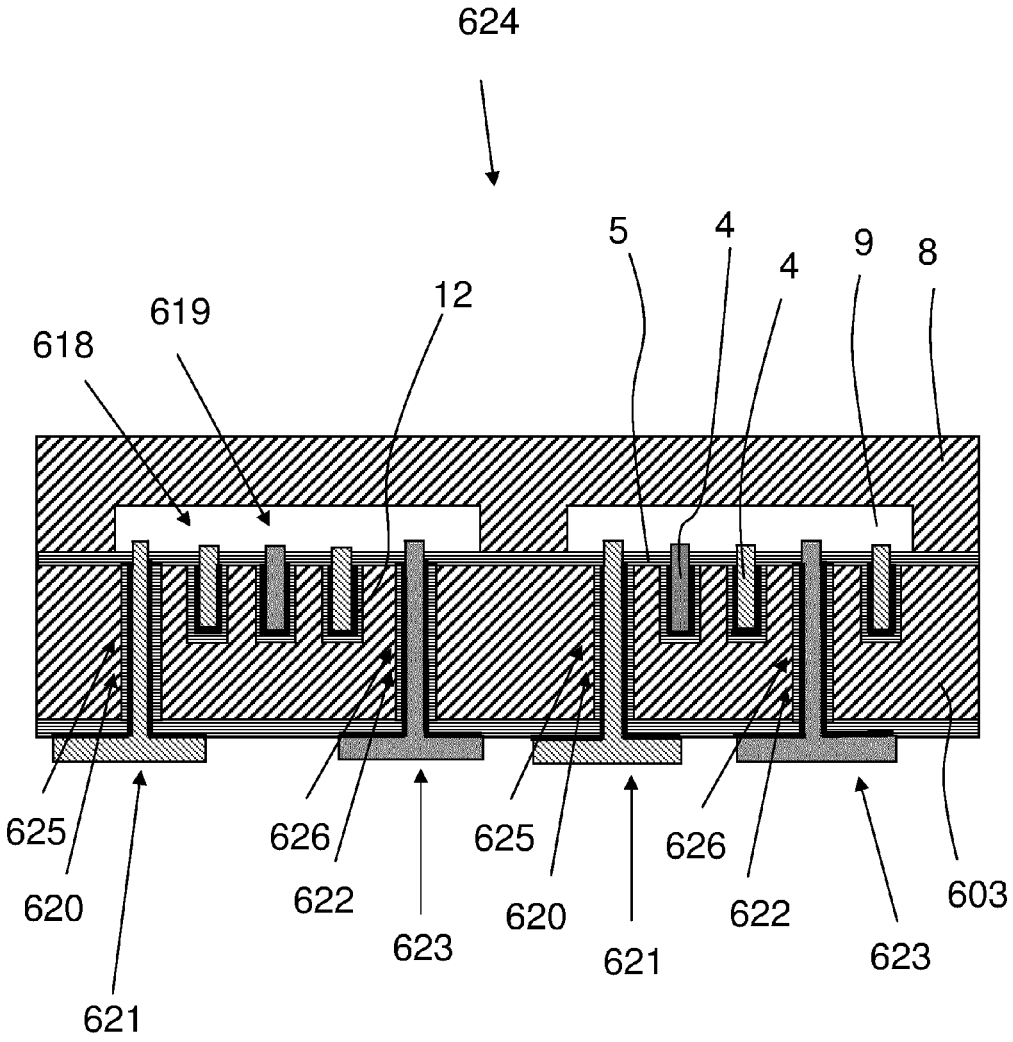
FIG. 6 shows a schematic lateral view of one embodiment of a transformer with planar coils according to the present invention where the planar coils are located in the first magnetic core plate in an interleaving pattern.
Figure 7:
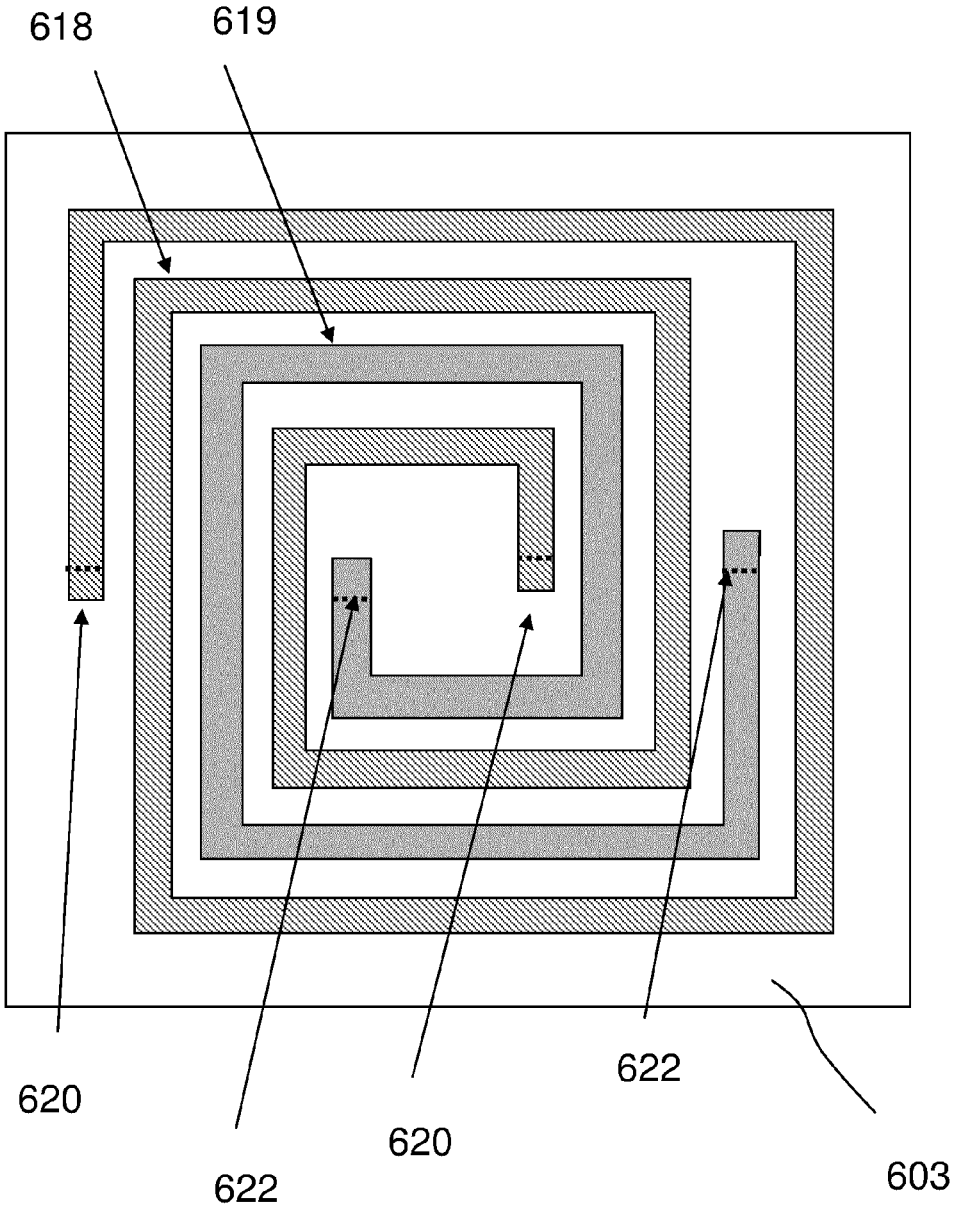
FIG. 7 shows a schematic plan view of one embodiment of a transformer with planar coils according to the present invention where the planar coils are located in the first magnetic core plate in an interleaving pattern, with the second magnetic core plate removed.

FIGS. 6 and 7 shows an embodiment of a transformer 624 with planar coils according to the invention where there is a first coil 618 and a second coil 619 located in the first magnetic core plate 603 in an interleaving pattern. The first coil 618 is connected to a plurality of first coil taps 620 which extend in first coil via holes 625 in the first magnetic core plate 603 to first coil contact pads 621 and the second coil 619 is connected to a plurality of second coil taps 622 which extend in second coil via holes 626 in the first magnetic core plate 603 to second coil contact pads 623.

Figure 8:
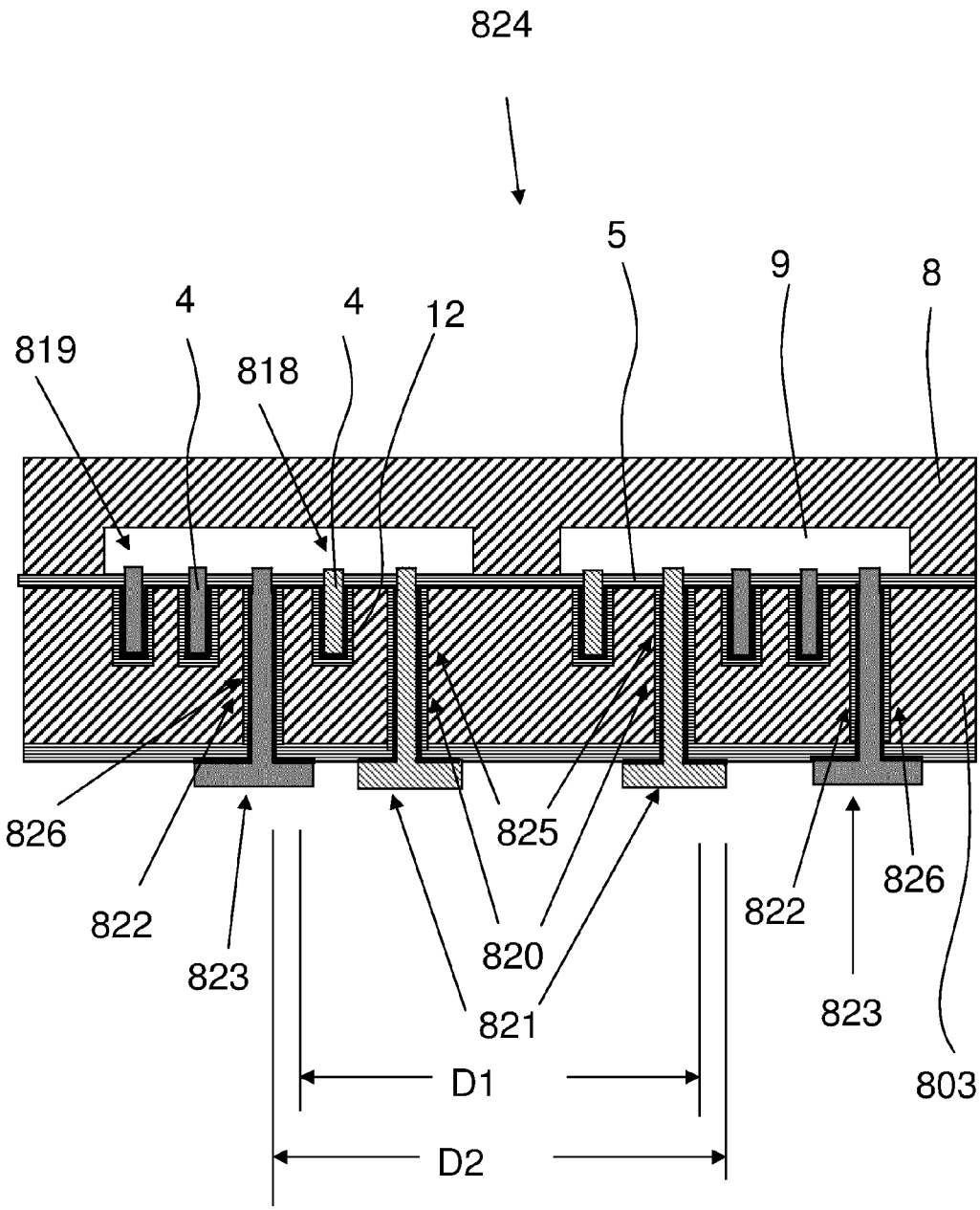
FIG. 8 shows a schematic lateral view of another embodiment of a transformer with planar coils according to the present invention where the planar coils are located in the first magnetic core plate in a radially sequential pattern.

FIG. 8 shows another embodiment of a transformer 824 with planar coils according to the invention where there is a first coil 818 with a maximum diameter D1, and a second coil 819 with a minimum diameter D2 which is greater than D1 which are located in the first magnetic core plate 803 in a radially sequential pattern. Preferably first coil 818 is concentric with second coil 819. The first coil 818 is connected to a plurality of first coil taps 820 which extend in first coil via holes 825 in the first magnetic core plate 803 to first coil contact pads 821 and the second coil is connected to a plurality of second coil taps 822 which extend in second coil via holes 826 in the first magnetic core plate 803 to second coil contact pads 823.

Figure 9:
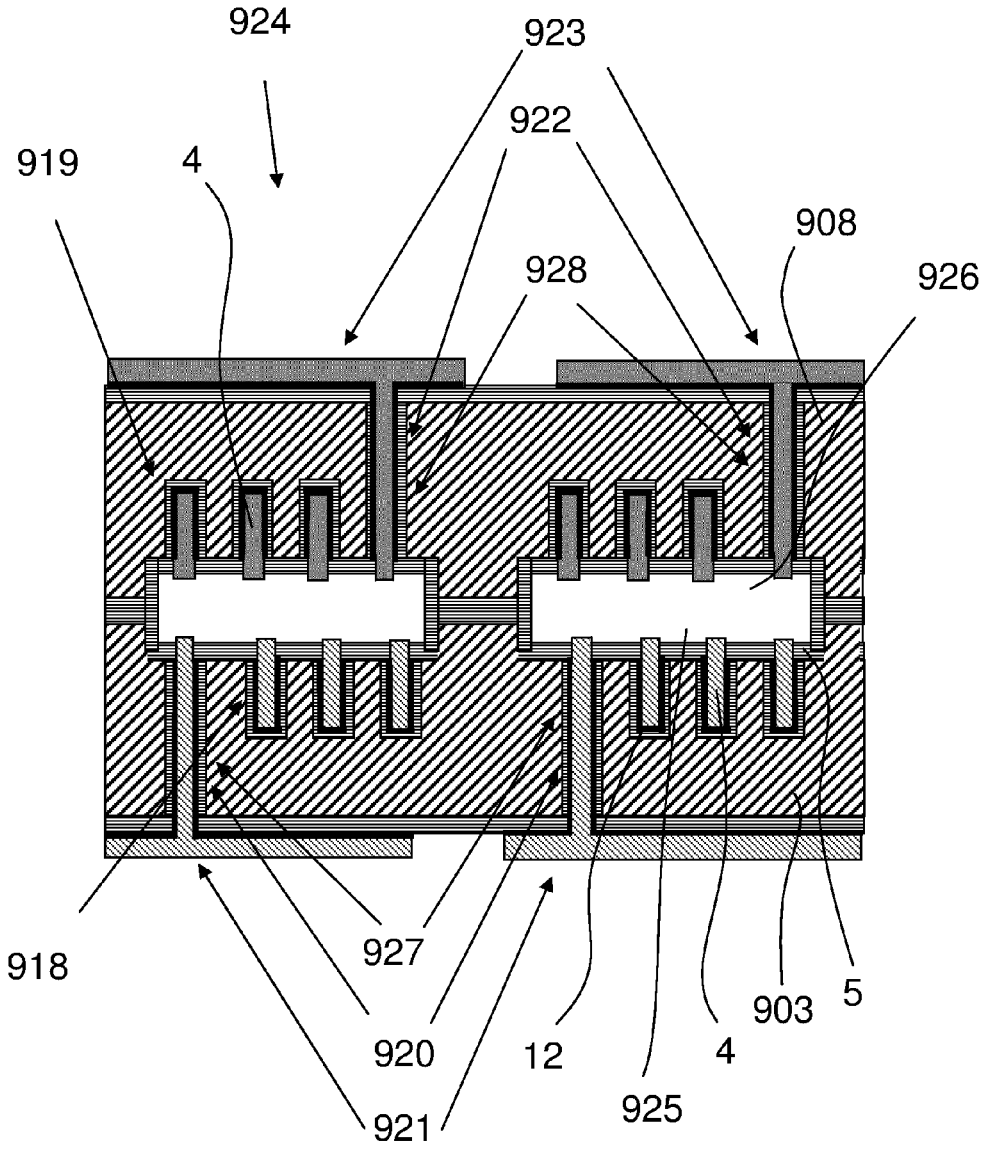
FIG. 9 shows a schematic lateral view of yet another embodiment of a transformer with planar coils according to the present invention where a planar coil is located in the first magnetic core plate connected with taps through the first magnetic core plate, and another planar coil is located in the second magnetic core plate connected with taps through the second magnetic core plate.

FIG. 9 shows yet another embodiment of a transformer 924 with planar coils according to the invention where the first coil 918 is located in the first magnetic core plate 903 and the second coil 919 is located in the second magnetic core plate 908. The first coil 918 is connected to a plurality of first coil taps 920 which extend in first coil via holes 927 in the first magnetic core plate 903 to the first coil contact pads 921. The first magnetic core 903 has a recess 925 and the second magnetic core 908 has a recess 926. Other configurations are also conceivable with, for example, a recess in only one magnetic core plate. The second coil 919 is connected to a plurality of second coil taps 922 which extend in second coil via holes 928 in the second magnetic core plate 908 to second contact coil pads 923.

Figure 10:
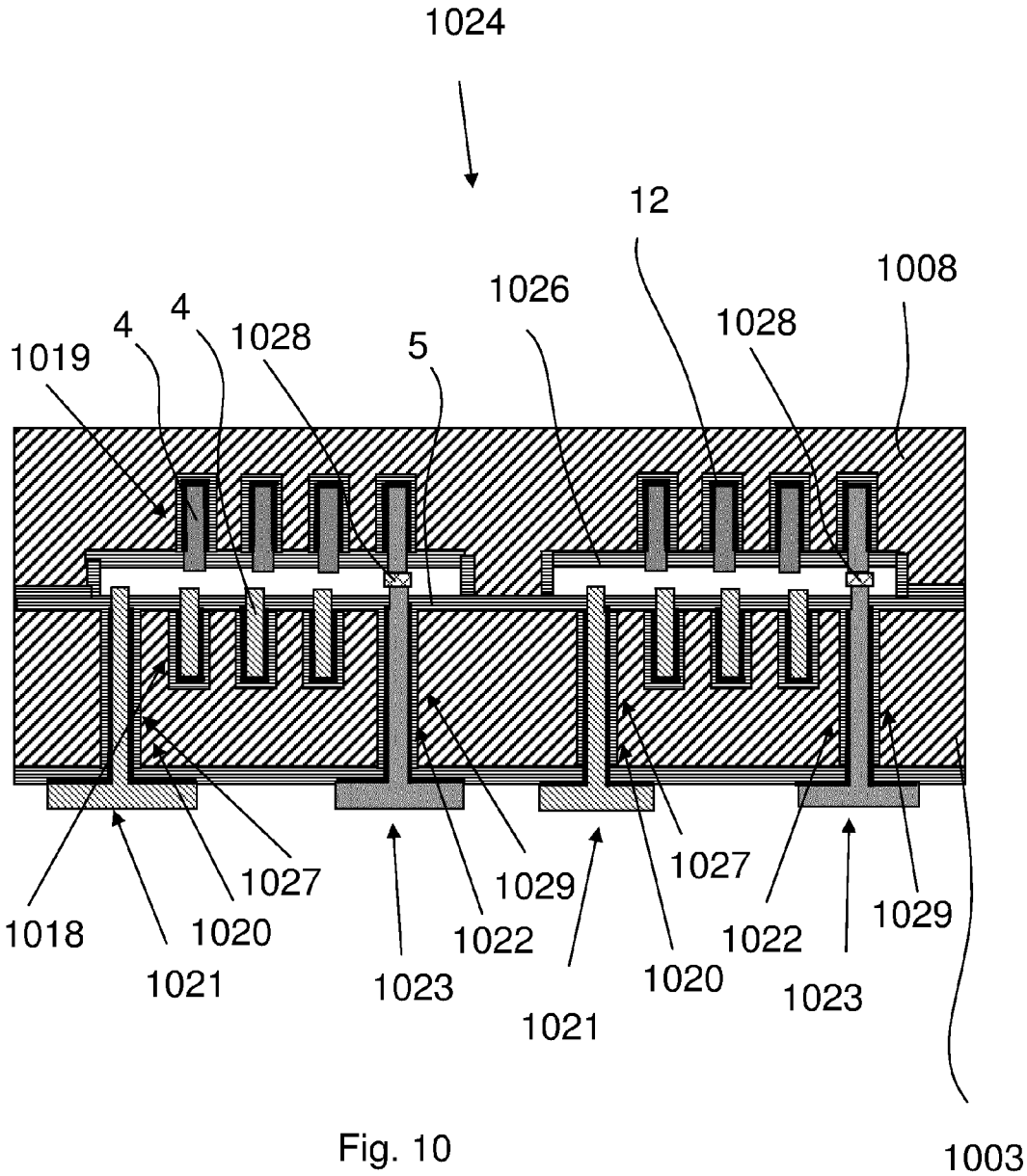
FIG. 10 shows a schematic lateral view of a further embodiment of a transformer with planar coils according to the present invention where a planar coil is located in the first magnetic core plate connected with taps through the first magnetic core plate, and another planar coil is located in the second magnetic core plate connected with taps through the first magnetic core plate.

FIG. 10 shows a further embodiment of a transformer 1024 with planar coils according to the invention where the first coil 1018 is located in the first magnetic core plate 1003 and the second coil 1019 is located in the second magnetic core plate 1008. The first coil 1018 is connected to a plurality of first coil taps 1020 which extend in first coil via holes 1027 in the first magnetic core plate 1003 to first coil contact pads 1021. The second magnetic core has a recess 1026. Other configurations are also conceivable with, for example, recesses in both magnetic core plates. The second coil 1019 is connected via solder 1028 to a plurality of second coil taps 1022 which extend in second coil via holes 1029 in the first magnetic core plate 1003 to second coil contact pads 1023.

Figure 11A:
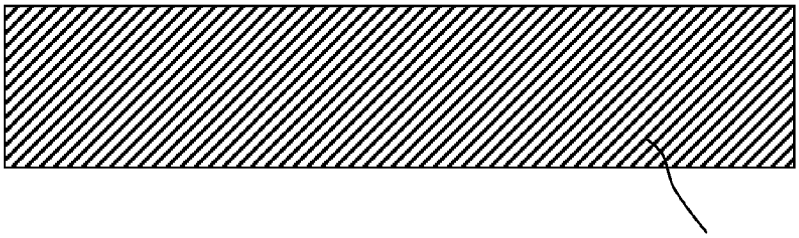
FIG. 11 shows schematic lateral views in the different stages in the manufacturing of coil assembly according to the present invention.

One method of forming a coil assembly according to the invention comprises the following steps:

Providing a first magnetic core plate 3, preferably with a thickness T1 of more than 200 μm up to 5000 μm, see FIG. 11*a*.

Figure 11B:
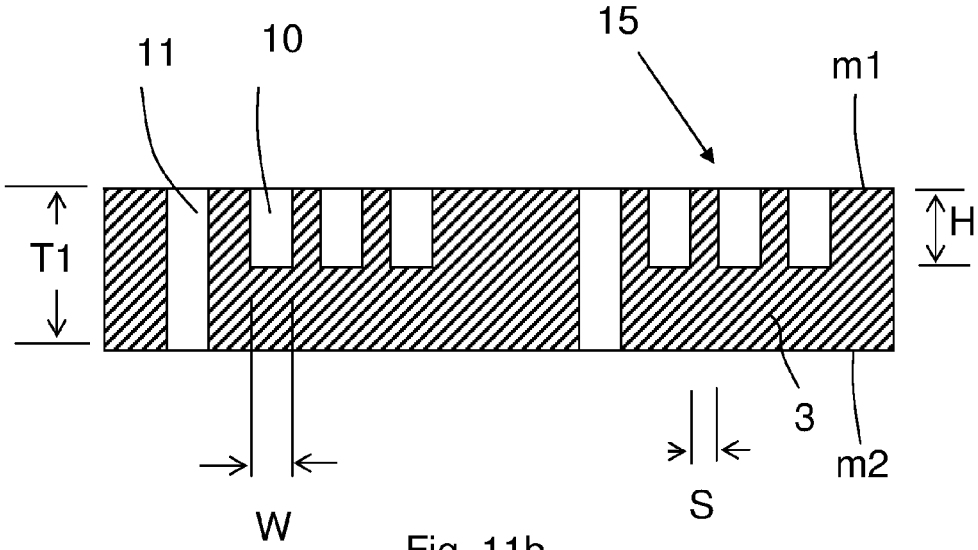

Providing a trench 10 in the form of a turn 15 pattern with trench depth H preferably in the range of 100 μm to 1000 μm in the side m1 of the first magnetic core plate 3 and via holes 11 from the side m1 of the first magnetic core plate where the trench 10 is present through the first magnetic core plate 3 to the opposite side m2 for example by milling, sand blasting, water jetting, see FIG. 11*b*. The turns 15 of the trench 10 preferably has a width W in the range of 50 μm to 1000 μm, even more preferably in the range of 200 μm to 800 μm, and the spacing S between the turns 15 of trench 10 is preferably in the range of 50 μm to 1000 μm. The ratio of the width W of the turns 15 of the trench 10 to the depth H of the trench 10 is preferably 1:1.2 to 1:20 and more preferably 1:2 to 1:5. The thickness T1 of the first magnetic core plate 3 is preferably in the range of more than 100 μm up to 4000 μm thicker than the depth H of the trench 10.

Figure 11C:
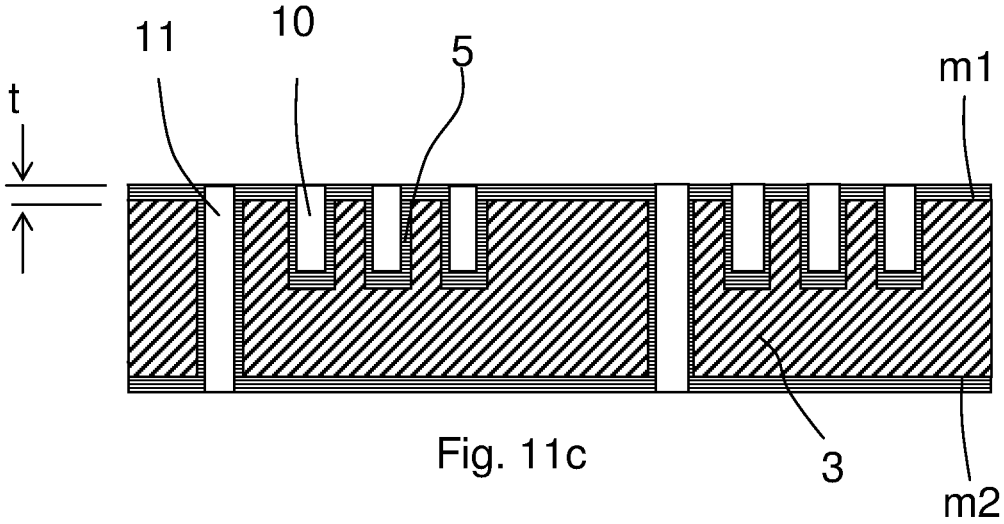

Providing an insulator layer 5 covering at least the bottom of trench 10 and a substantial part of the sidewalls of the trench 10 as well as the sidewall of each via hole 11. Preferably, the insulator layer is deposited conformally on all surfaces, as shown in FIG. 11*c*, using for example chemical vapour deposition of poly(p-xylylene) polymers (e.g. Parylene™). The thickness t of the insulator layer 5 is preferably in the range of 1 μm to 50 μm.

Figure 11D:
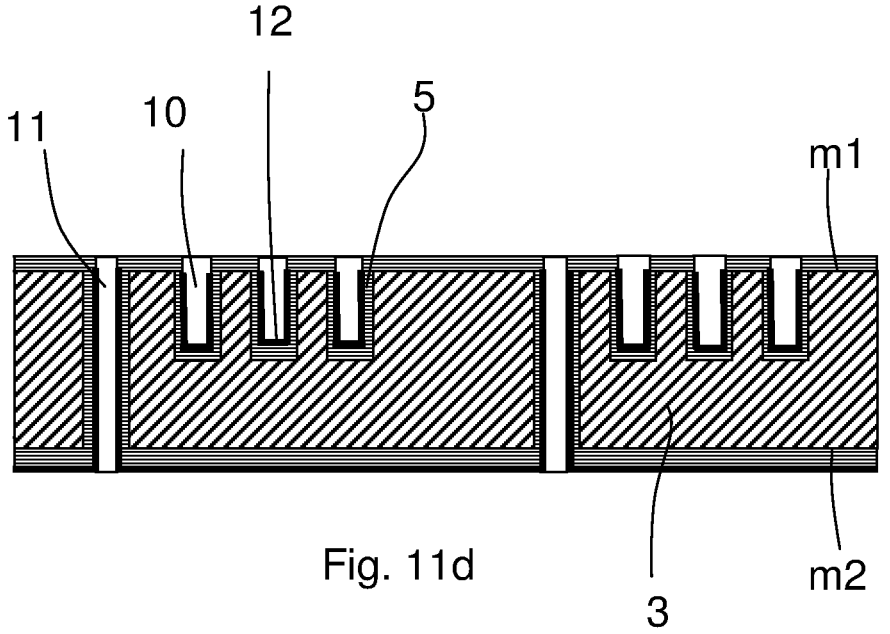

Providing a seed layer 12, see FIG. 11*d*, by for example deposition on the side m1 of the first magnetic core plate 3 where the trench 10 is present and the opposite side m2 of the first magnetic core plate 3. The side m1 of the first magnetic core plate where the trench 10 is present is then patterned by lithography and etching, leaving a metal layer in trench 10 and via holes 11. The seed layer 12 remains on the opposite side m2 of the first magnetic core plate 3. Alternatively, for the side m1 of the first magnetic core plate 3 where the trench 10 is present, selective top side deposition through shadow-mask structures that only deposits metal in the bottom of the trench 10 and in the via holes 11 could be used. The seed layer 12 preferably comprises Ti—Cu, TiW—Cu but it could also be other types of metal. The total thickness of the seed layer 12 is preferably in the range of 100 nm to 700 nm.

Optionally (not shown) providing a photoresist, preferably in a non-conformal layer, by for example dry lamination, performing lithography and thereby removing the resist in the trench area.

Figure 11E:
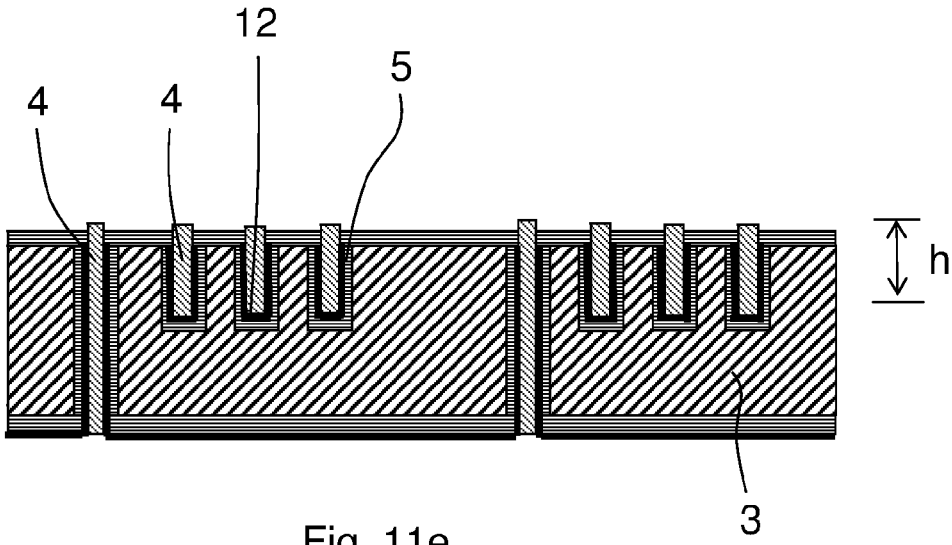

Providing coil conductive material 4, for example copper (Cu), by electroplating, filling the trench 10 and the via holes 11 in the same process stage, see FIG. 11*e*. The height h of coil conducting material 4 of the turns of the coil 2 is preferably in the range of more than 100 μm up to 1100 μm, more preferably in the range of more than 150 μm up to 1100 μm, and even more preferably in the range of more than 200 μm up to 1100 μm.

Figure 11F:
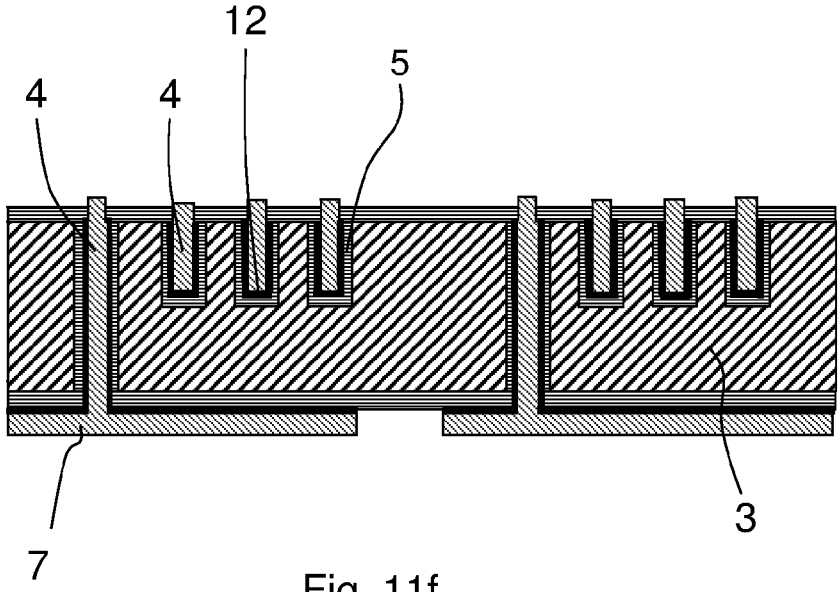

Providing contact pads 7 on the side of the first magnetic core plate opposite to the side with the coil 2, see FIG. 11*f*. Alternatively, one or more of the contact pads 7 can be provided in the same process stage as when the filling of the trench 10 and the via holes 11 is done.

Providing a second magnetic core plate 8 with preferably a thickness T2 in the range of 50 μm to 4000 μm.

Figure 11G:
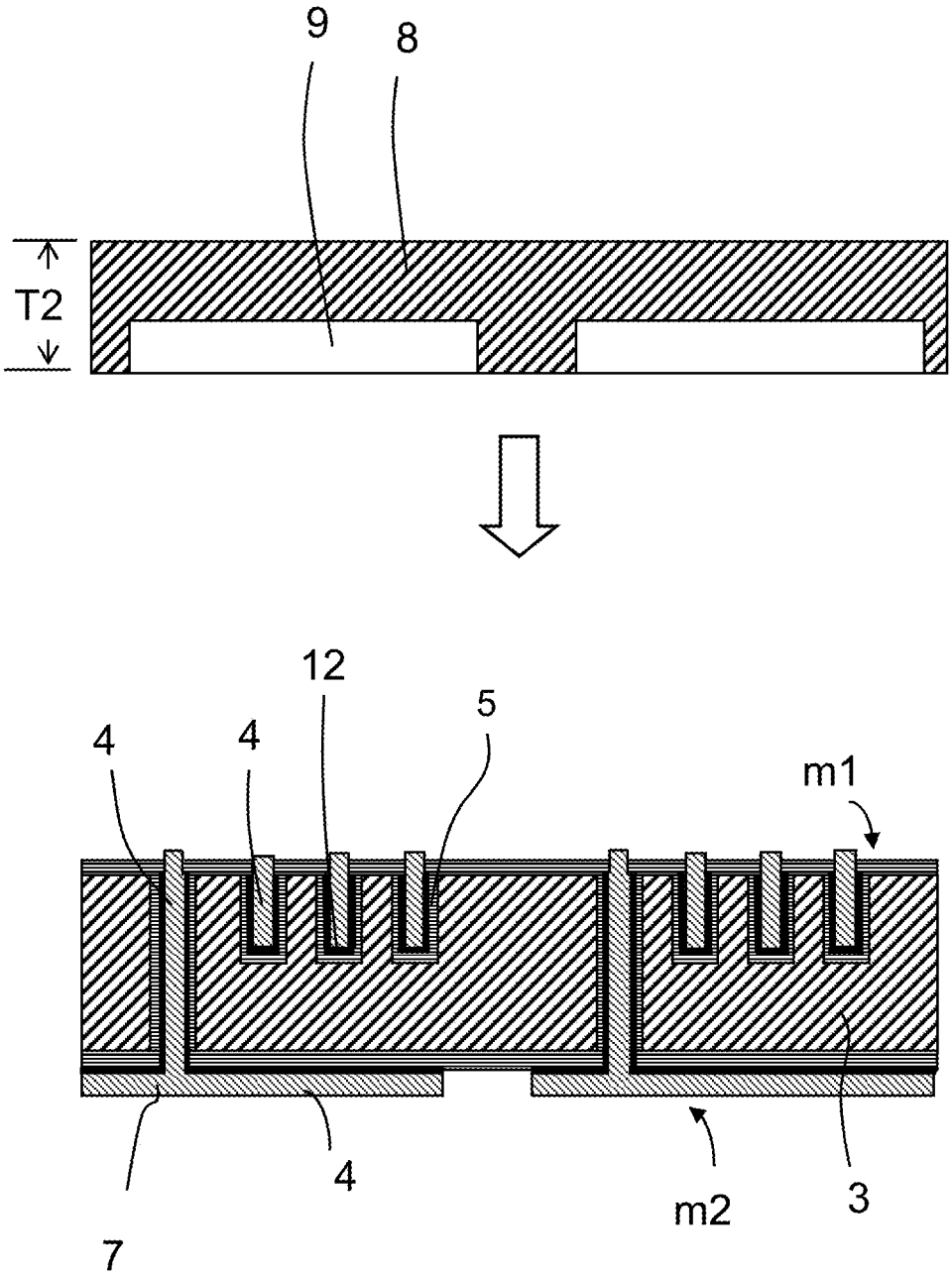

Providing a recess 9 in the second magnetic core plate, see FIG. 11*g*.

Mounting the second magnetic core plate 8 on the first magnetic core plate 3 using for example gluing, mechanical clamping or soldering.

Figure 12A:
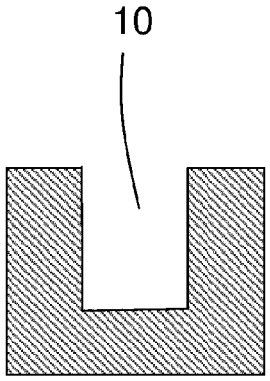
FIG. 12 shows schematic lateral views of alternative shapes of trench in coil assemblies according to the present invention.
Figure 12B:
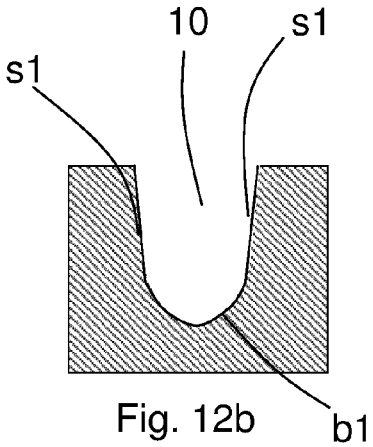
Figure 12C:
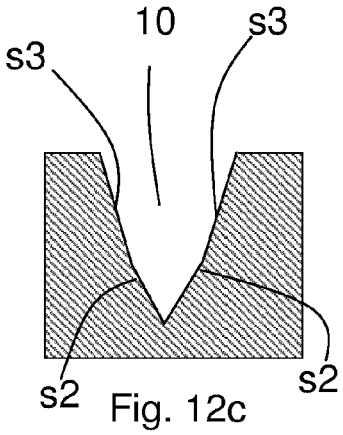
Figure 12D:
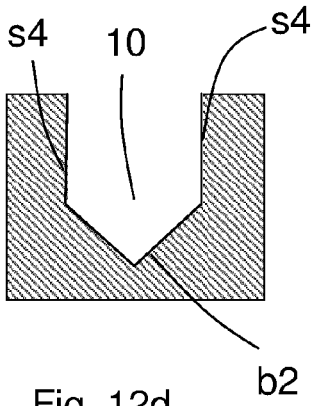
Figure 12E:
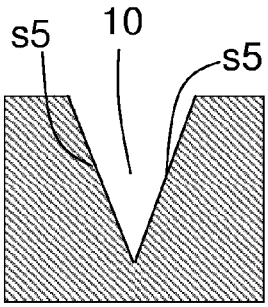
Figure 12F:
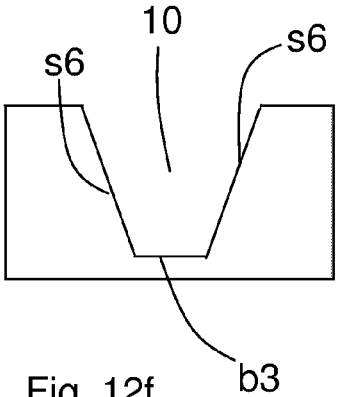

FIGS. 12*a-f* shows examples of different cross-sectional shapes of the trench 10 in the first magnetic cote plate 3 or second magnetic core plate 8 in accordance with the present invention. FIG. 12*a* shows a trench 10 with a rectangular cross section. FIG. 12*b* shows a trench 10 with a rounded bottom b1 and upper sidewalls s1 slightly sloping. FIG. 12*c* shows a trench 10 with a V-shape with less steep lower sidewalls s2 than upper sidewalls s3. FIG. 12*d* shows a trench 10 with a V-shaped bottom b2 and vertical upper sidewalls s4. FIG. 12*e* shows a trench 10 with a V-shape where the slope is the same along each sidewall s5. FIG. 12*f* shows a trench 10 with a flat bottom b3 and sloping sidewalls s6. A rounded shape of the trench, such as shown in FIG. 12*b*, may be advantageous to reduce the magnetic field concentration, whereas V-grooved shapes provide advantages for Cu electroplating trench fill.

Figure 13A:
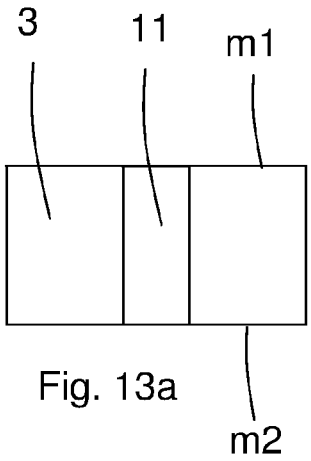
FIG. 13 shows schematic lateral views of different shapes of a via hole in coil assemblies according to the present invention.
Figure 13B:
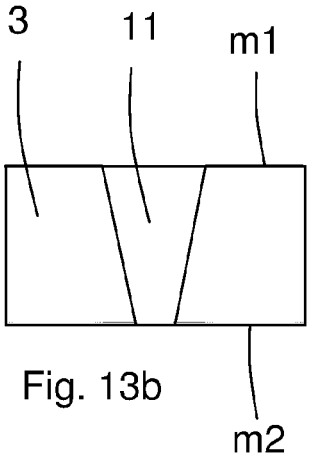
Figure 13C:
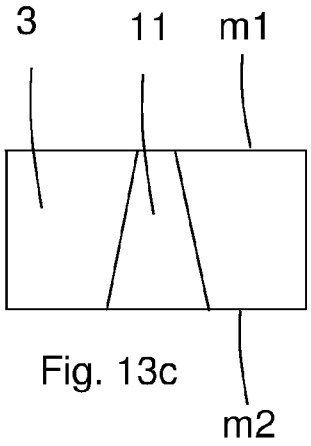
Figure 13D:
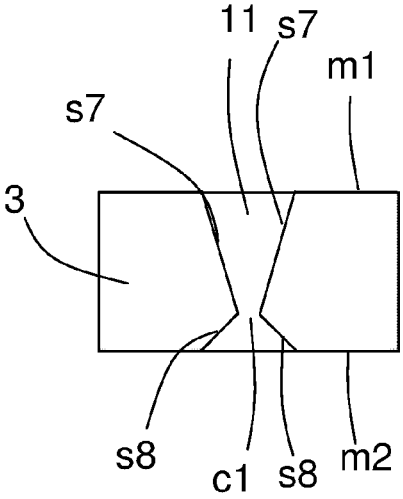
Figure 13E:
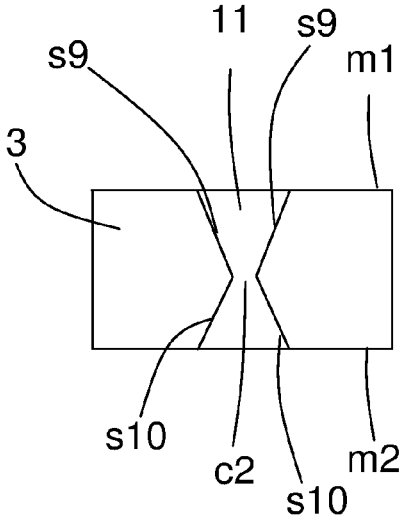

FIGS. 13*a-e* shows examples of different shapes of a via hole 11 in accordance with the present invention. The via hole 11 could have for example a rectangular, elliptical, or circular cross section in the plane perpendicular to the length of the via hole 11 extending between the trench 10 and the opposite side m2 of the first magnetic core plate 3, where the cross sectional shape and dimensions are the same over the complete length of the via hole 11, see FIG. 13*a*. Alternatively, the cross sectional shape and dimensions, such as the width of any of the sides in the case of a rectangular cross section, or radius in the case of an elliptical or circular cross section, could be varying over the length of the via hole 11. The via hole 11 then has sloping sidewalls which are easier to deposit with a seed layer. Sloping sidewalls also make it easier to obtain a void free fill of the via hole during electroplating. With sloping sidewalls, the via hole could be widening towards the side m1 of the first magnetic core plate 3 where the trench 10 is present, see FIG. 13*b*, or towards the opposite side m2 of the first magnetic core plate 3, see FIG. 13*c*, the via hole in these cases thereby taking a shape of for example a truncated pyramid or cone. The slope of a sidewall can also differ along the length of the via hole 11. The sidewall can then have a rounded slope or more distinct sections of different slopes along the length of the via hole 11 extending between the side m1 of the first magnetic core plate 3 where the trench 10 is present and the opposite side m2 of the first magnetic core plate 3. The slope can even change direction relative to the vertical, thereby forming a constriction in the via hole 11. FIG. 13*d* shows an example where the upper sidewalls s7 are narrowing towards the interior of the first magnetic core plate 3, thereby making the via hole 11 wider towards the side m1 of the first magnetic core plate 3 where the trench 10 is present than it is in the interior of the via hole 11, and the lower sidewalls s8 are narrowing towards the interior of the first magnetic core plate 3, thereby making the via hole wider towards the opposite side m2 of the first magnetic core plate 3 than it is in the interior of the via hole 11. A constriction c1 is formed where the upper sidewalls s7 and lower sidewalls s8 meet. With this configuration, a further advantage of mechanical support of the tap is obtained which improves the robustness and the reliability of the device. A special symmetric case of this configuration is seen in FIG. 13*e* where the constriction c2 is located in the middle of the first magnetic core plate 3 and the respective upper sidewall s9 and the respective lower sidewall s10 are mirrored to each other. In other configurations the constriction could be extended over a section of the length of the via hole 11, the constriction thereby taking the shape of for example a cylinder or a parallelepiped. The examples of different shapes of a via hole 11 described this paragraph are of course also applicable to via holes through the second magnetic core plate 8.

The present invention also relates to a magnetic core plate comprising a trench 10 in which a planar coil 2 comprising a plurality of turns 15 is arranged, wherein least one tap 6 extends from said coil 2 in a respective via hole 11 through said magnetic core plate 3 to a respective contact pad 7, wherein the coil 2 and the tap 6 are integrally formed. Such a magnetic core plate may also include a contact pad integrally formed with the tap.

The invention is not intended to be limited to the embodiments shown but is intended to include all embodiments covered within the scope of the appended claims.

The invention claimed is:

1. A method of manufacturing a coil assembly device including a planar coil comprising a plurality of turns, comprising:

providing a first magnetic core plate with a thickness in a range of more than 200 μm up to 5000 μm, providing a trench formed in a turn pattern with a depth in a range of 100 μm to 1000 μm, a width of turns of the trench in a range of 50 μm to 1000 μm, and spacing between the turns of the trench in a range of 50 μm to 1000 μm in the first magnetic core plate, and providing via holes through the first magnetic core plate, a ratio of the width of the turns of the trench to the depth of the trench being 1:1.2 to 1:20, the thickness of the first magnetic core plate being in a range of more than 100 μm up to 4000 μm thicker than the depth of the trench, providing an insulator layer covering at least a bottom of the trench, a substantial part of sidewalls of the trench, and a sidewall of each of the via holes, the insulator layer being deposited conformally on all surfaces, and a thickness of the insulator layer being in a range of 1 μm to 50 μm, providing a seed layer in the trench, a total thickness of the seed layer being in a range of 100 nm to 700 nm, providing coil conducting material by electroplating, filling the trench and the via holes during a same stage, a height of coil conducting material of the turns of the coil being in a range of more than 100 μm up to 1100 μm, providing a second magnetic core plate with a thickness in a range of 50 μm to 4000 μm, providing a recess in the second magnetic core plate, and mounting the second magnetic core plate on the first magnetic core plate, wherein at least one tap extends from the coil in a respective via hole through the first magnetic core plate to a respective contact pad, and the coil and the at least one tap are integrally formed.

2. The method according to claim 1, wherein coil conducting material is provided on a side of the first magnetic core plate which is opposite to a side of the first magnetic core plate where the trench is present.

3. The method according to claim 1, wherein the seed layer is deposited through a shadow mask.

* * * * *